US010167666B2

(12) United States Patent
Siller et al.

(10) Patent No.: US 10,167,666 B2
(45) Date of Patent: Jan. 1, 2019

(54) FENESTRATION MEMBER SEALING SYSTEM

(71) Applicant: Westhampton Architectural Glass, Inc., Westhampton Beach, NY (US)

(72) Inventors: Paul T. Siller, Remsenburg, NY (US); Robert B. Busking, Jr., Remsenburg, NY (US); Robert Busking, Sr., Westhampton Beach, NY (US)

(73) Assignee: WESTHAMPTON ARCHITECTURAL GLASS, INC., Westhampton Beach, NY (US)

( * ) Notice: Subject to any disclaimer, the term of this patent is extended or adjusted under 35 U.S.C. 154(b) by 0 days.

(21) Appl. No.: 15/067,718

(22) Filed: Mar. 11, 2016

(65) Prior Publication Data

US 2017/0260799 A1 Sep. 14, 2017

(51) Int. Cl.

| | |
|---|---|
| ***E06B 7/205*** | (2006.01) |
| ***E06B 7/18*** | (2006.01) |
| ***E06B 7/21*** | (2006.01) |
| *E06B 7/20* | (2006.01) |

(52) U.S. Cl.

CPC ..... *E06B 7/18* (2013.01); *E06B 7/21* (2013.01); *E06B 2007/202* (2013.01)

(58) Field of Classification Search

CPC ... E06B 7/18; E06B 7/21; E06B 7/205; E06B 2007/202

USPC ..... 49/303, 306, 307, 308, 316, 317, 319

See application file for complete search history.

(56) References Cited

U.S. PATENT DOCUMENTS

| | | | | | |
|---|---|---|---|---|---|
| 630,216 | A | * | 8/1899 | Grover | E06B 7/20 49/309 |
| 639,026 | A | * | 12/1899 | Fernald | E06B 7/20 49/307 |
| 754,819 | A | * | 3/1904 | Senglar | E06B 7/20 49/307 |
| 1,556,091 | A | * | 10/1925 | Edwards | E06B 7/20 49/307 |
| 1,561,195 | A | * | 11/1925 | Szymkowiak | E06B 7/20 49/307 |

(Continued)

FOREIGN PATENT DOCUMENTS

| | | |
|---|---|---|
| CN | 104879047 A | 9/2015 |
| EP | 0221207 A1 | 5/1987 |

(Continued)

*Primary Examiner* — Catherine A Kelly
(74) *Attorney, Agent, or Firm* — Jones Robb, PLLC

(57) ABSTRACT

The system includes a gear mounted for rotation relative to the fenestration member. A mechanical linkage connects the latch control member and the gear such that the gear is rotated from a first position, where the latch is disengaged, to a second position as the latch is moved to engage the fenestration member frame. A rack in engagement with the gear is mounted to a first bar for linear movement in a given direction as the gear is rotated. A first triangular member moves with the rack. A second triangular member attached to a second bar cooperates with the first triangular member to move the second bar in a direction substantially perpendicular to the direction of rack movement. A gasket moves with the second bar to a position abutting the adjacent surface to automatically seal the member to the adjacent surface as the member is latched.

19 Claims, 3 Drawing Sheets

(56) References Cited

U.S. PATENT DOCUMENTS 2,765,504 A * 10/1956 Laumann ..... E06B 7/18 292/36
2,848,767 A 8/1958 Thompson
3,331,158 A 7/1967 Frakes
3,334,441 A 8/1967 Landis et al.
3,704,547 A 12/1972 Hansen et al.
3,776,581 A 12/1973 Ross
3,812,316 A 5/1974 Milburn
3,923,327 A 12/1975 Ross
4,045,913 A * 9/1977 Wright ..... E06B 7/20 49/307
4,425,738 A 1/1984 Christensen
4,805,345 A 2/1989 Ohi
5,012,611 A * 5/1991 Hsu ..... E06B 7/18 49/225
5,060,991 A 10/1991 Davidian et al.
5,172,944 A 12/1992 Munich et al.
5,346,266 A 9/1994 Bisbing
5,454,192 A * 10/1995 Adler ..... E06B 7/215 49/307
5,642,588 A 7/1997 Sowers
6,023,952 A 2/2000 Mantarakis et al.
6,105,313 A * 8/2000 Holloway ..... E05C 19/001 49/318
6,195,939 B1 * 3/2001 Sowers ..... E06B 7/21 49/307
6,256,932 B1 7/2001 Jyawook et al.
7,008,032 B2 3/2006 Chekal et al.
7,143,546 B2 * 12/2006 Griffis ..... B60J 5/0497 49/308
7,260,915 B2 * 8/2007 Cronenberg ..... E06B 7/215 49/306
7,644,539 B2 1/2010 Baxter
8,091,282 B2 * 1/2012 Speyer ..... E05C 9/063 49/316
8,347,649 B1 1/2013 Gavin et al.
8,631,606 B2 1/2014 Hans
8,745,924 B2 6/2014 Tshai
8,869,868 B1 10/2014 Schmidt
8,925,250 B2 1/2015 Parker
D738,532 S 9/2015 Kuan
2008/0196313 A1 * 8/2008 Fink ..... E06B 7/20 49/380
2010/0018122 A1 1/2010 Hecht et al.
2010/0064590 A1 3/2010 Jones et al.
2010/0287844 A1 * 11/2010 Harrison ..... E06B 7/18 49/480.1
2011/0127895 A1 6/2011 Conn et al.
2014/0102005 A1 4/2014 Hans
2015/0121763 A1 * 5/2015 Zafeiropoulos ..... E05C 19/001 49/394
2015/0152679 A1 6/2015 Kolobayev et al.
2015/0233175 A1 * 8/2015 Parker ..... E06B 7/215 49/304
2016/0069107 A1 * 3/2016 Uyeda ..... E06B 5/164 49/316
2016/0069125 A1 * 3/2016 Kleiner ..... E06B 7/18 49/316

FOREIGN PATENT DOCUMENTS

GB 498180 A * 1/1939 ..... E06B 7/18
GB 846642 8/1960
GB 1064642 A * 4/1967 ..... E06B 7/18
JP 05163877 A * 6/1993
WO 2014029877 2/2014

* cited by examiner

FENESTRATION MEMBER SEALING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to weather-proof constructions for doors, windows or other fenestration members and more particularly to a construction which includes a system for sealing the bottom or side of the fenestration member to an adjacent surface such as the threshold saddle, frame or jamb when the fenestration member is closed.

2. Description of Prior Art Including Information Disclosed Under 37 CFR 1.97 and 1.98

Various methods have been used to weather strip doors, windows or other fenestration members to avoid air from entering a building or other enclosure through the gap between the fenestration member and the adjacent surfaces including the saddle, jamb or frame when the fenestration member is closed. Strips of insulating products such as metal, felt, foam, rubber or other resilient materials have been attached to the fenestration member or surfaces adjacent the fenestration member in order to seal the gap between the fenestration member and those surfaces. Metal strips with rubber gaskets have been attached to the fenestration member such that they extend over the gap to prevent air from entering beneath or around the fenestration member when the fenestration member is closed. However, regardless of the materials or configurations, stationary strips must allow sufficient clearance for the fenestration member to open and close without interference and thus cannot seal the fenestration member completely.

Elongated articles of insulating material of different sizes and shapes have also been placed against the bottom of the fenestration member to prevent air from passing under the fenestration member. However, those articles must be removed each time when the fenestration member is opened.

Because none of those methods have proved satisfactory, there is a need for a system which will create a highly effective seal between the fenestration member and adjacent surfaces of fenestration member frame, jamb or saddle when the fenestration member is closed and automatically retract when the fenestration member is unlatched to allow the fenestration member to be opened without interference.

It is, therefore, a prime object of the present invention to provide a fenestration member sealing system.

It is another object of the present invention to provide a fenestration member sealing system which includes a gasket mounted to the fenestration member which is moved from a position remote from the adjacent surface of the fenestration member frame or saddle to a sealing position abutting the adjacent surface to seal the gap between the fenestration member and the adjacent surface.

It is another object of the present invention to provide an automatic fenestration member sealing system which includes a gasket mounted to the fenestration member which is automatically moved to a position abutting the adjacent surface as the fenestration member is latched.

It is another object of the present invention to provide an automatic fenestration member sealing system which includes a gasket mounted to the fenestration member which is automatically moved to the abutting position by a mechanism including oppositely oriented triangular members with inclined surfaces which cooperate to cause the gasket to move to the abutting position as the fenestration member is latched.

It is another object of the present invention to provide an automatic fenestration member sealing system which includes a gasket mounted to the fenestration member which is automatically moved to the abutting position by a mechanism which includes a rack and gear assembly.

It is another object of the present invention to provide an automatic fenestration member sealing system which includes a gasket mounted to the fenestration member which is automatically moved to the abutting position by an internal mechanical linkage extending between the fenestration member latch control and the structure that moves the gasket as the fenestration member is latched.

BRIEF SUMMARY OF THE INVENTION

In general, the above noted objects are achieved by the present invention which relates to a system for sealing a fenestration member to an adjacent frame surface such as a saddle, jamb or frame. The fenestration member has a latch and a member which controls the position of the latch to engage or disengage the fenestration member frame. The system includes a gear mounted for rotation relative to the fenestration member. A mechanical linkage connects the latch control member and the gear such that the gear is rotated from a first position, where the latch is disengaged, to a second position as the latch is moved to engage the fenestration member frame. A rack in engagement with the gear is mounted to the fenestration member for linear movement in a given direction as the gear is rotated. A first triangular member moves with the rack. A second triangular member cooperates with the first triangular member to move the second triangular member in a direction substantially perpendicular to the direction of rack movement. A gasket moves with the second cam member to a position abutting the adjacent frame surface to seal the fenestration member as the latch is moved to engage the fenestration member frame.

The first triangular member includes an inclined surface. The second triangular member includes a second inclined surface. The first inclined surface and the section inclined surface cooperate to move the gasket toward and away from the adjacent fenestration member surface.

A spring connects extends between the gasket and the fenestration member. The spring urges the first triangular member and the second triangular member toward each other.

The rack and the first triangular member are mounted on a bar. The bar extends across and is movable along the fenestration member. The bar has an opening aligned with the spring such that the spring does not interfere with the movement of the bar.

Means are provided for preventing the gasket from moving relative to the fenestration member in the direction of rack movement.

In accordance with another aspect of the present invention, a system for sealing a fenestration member to an adjacent surface such as a fenestration member saddle, jamb or frame. The fenestration member has a latch and a member which controls the position of the latch to engage or disengage the fenestration member frame. The system includes a gear mounted for rotation relative to the fenestration member. A mechanical linkage connects the latch control member and the gear such that the gear is rotated from a first position, where the latch is disengaged, to a second position as the latch is moved to engage the fenestration member frame. A rack in engagement with the gear is mounted on a first bar for linear movement in a given direction as the gear is rotated. First and second triangular member sets are provided. Each triangular member set includes a first triangular member and a second triangular member. The first triangular member of each set moves with the first bar. The second triangular member of each set is mounted on a second bar and cooperates with the first triangular member of that set to move the second bar in a direction substantially perpendicular to the direction of movement of the first bar. A gasket moves with the second bar to a position abutting the adjacent frame surface to seal the fenestration member as the latch is moved to engage the fenestration member frame.

The first triangular member of each triangular member set includes an inclined surface. The second triangular member of each of triangular member set includes a second inclined surface. The first inclined surface and the second inclined surface of the triangular members of each triangular member set cooperate to move the second bar toward and away from the adjacent surface.

The system includes first and second spaced springs connecting the first bar and the second bar. The springs urge the first triangular member and the second triangular member of each triangular member set toward each other.

The first bar includes first and second openings aligned with the first and second springs, respectively, such that the springs do not interfere with the movement of the first bar.

The system includes means for preventing the second bar from moving in a direction substantially parallel to the first bar.

The system includes a rubber layer or gasket on the second bar.

In accordance with another aspect of the present invention, a combination of a fenestration member and system for sealing the fenestration member to an adjacent surface is provided. The fenestration member is associated with a frame and includes a latch and a member for controlling the position of the latch to engage and disengage the frame. The system includes a gear mounted for rotation relative to the fenestration member between a first position and a second position. A mechanical linkage connects the latch control member and the gear such that the gear is rotated from a first position wherein the latch does not engage the frame to a second position as the latch engages the frame. The gear engages a rack to move in a given direction as the gear is rotated between its first position and its second position. A first triangular member is movable with the rack. A second triangular member cooperates with the first triangular member to move the second triangular member in a direction substantially perpendicular to the direction of rack movement. A gasket is movable with the second triangular member to position abutting the adjacent frame surface to seal the fenestration member as the latch engages the frame.

BRIEF DESCRIPTION OF THE SEVERAL VIEWS OF DRAWINGS

To these and to such other objects that may hereinafter appears, the present invention relates to an automatic fenestration member sealing system as described in detail in the following specification and recited in the annexed claims, taken together with the accompanying drawings, in which like numerals refer to like parts and in which:

DETAILED DESCRIPTION OF THE INVENTION

Figure 1:
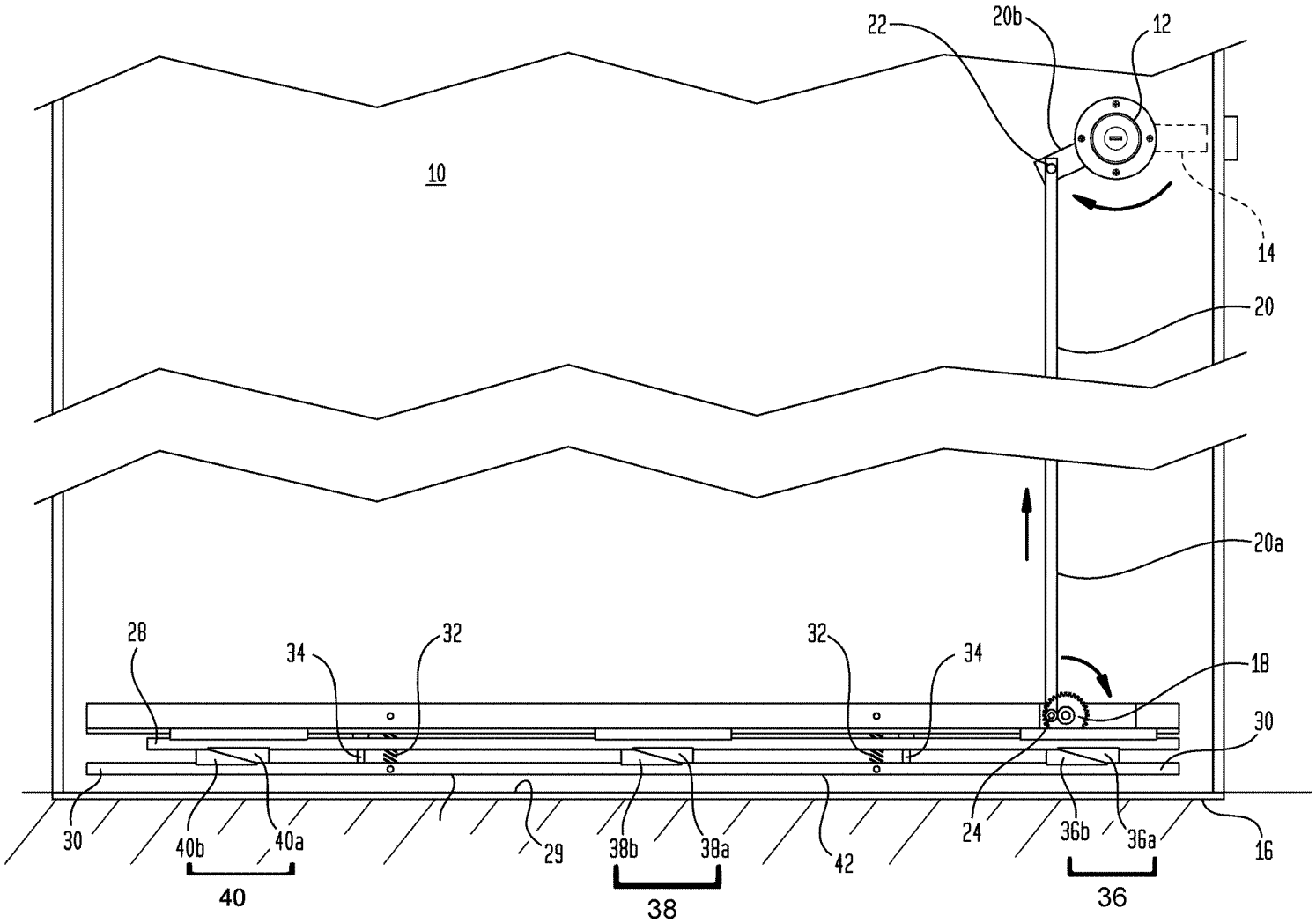
FIG. 1 is an elevation view of the interior of a door with the fenestration member sealing system, showing the gasket in a position remote from the adjacent frame surface of the door saddle.

For purposes of explanation, the preferred embodiment of the present invention is described and illustrated as it would be used to seal a fenestration member in the form of a door to an adjacent surface such as a saddle, jamb or frame against air passing around the door, through an entranceway and into a building. However, it should be understood that the present invention could be used to seal any type of fenestration member, such as a window, to an adjacent frame surface. Further, the seal created by the present invention could also be used to prevent water, dust particles, odors, fumes and the like from entering the building, as well as air.

Moreover, the present invention is intended for use with any type of fenestration member having a moveable latch control member. Such a moveable latch control member could take the form of a rotatable or moveable knob, lever or handle.

As seen in the drawings, the preferred embodiment of the sealing system of the present invention is designed for use on a fenestration member such as a door 10 which has a rotatable door knob 12 accessible from the exterior of the door. Door knob 12 controls the position of a latch 14 which is moved toward and away from an opening in door frame 16 to engage or disengage the door frame.

Figure 2:
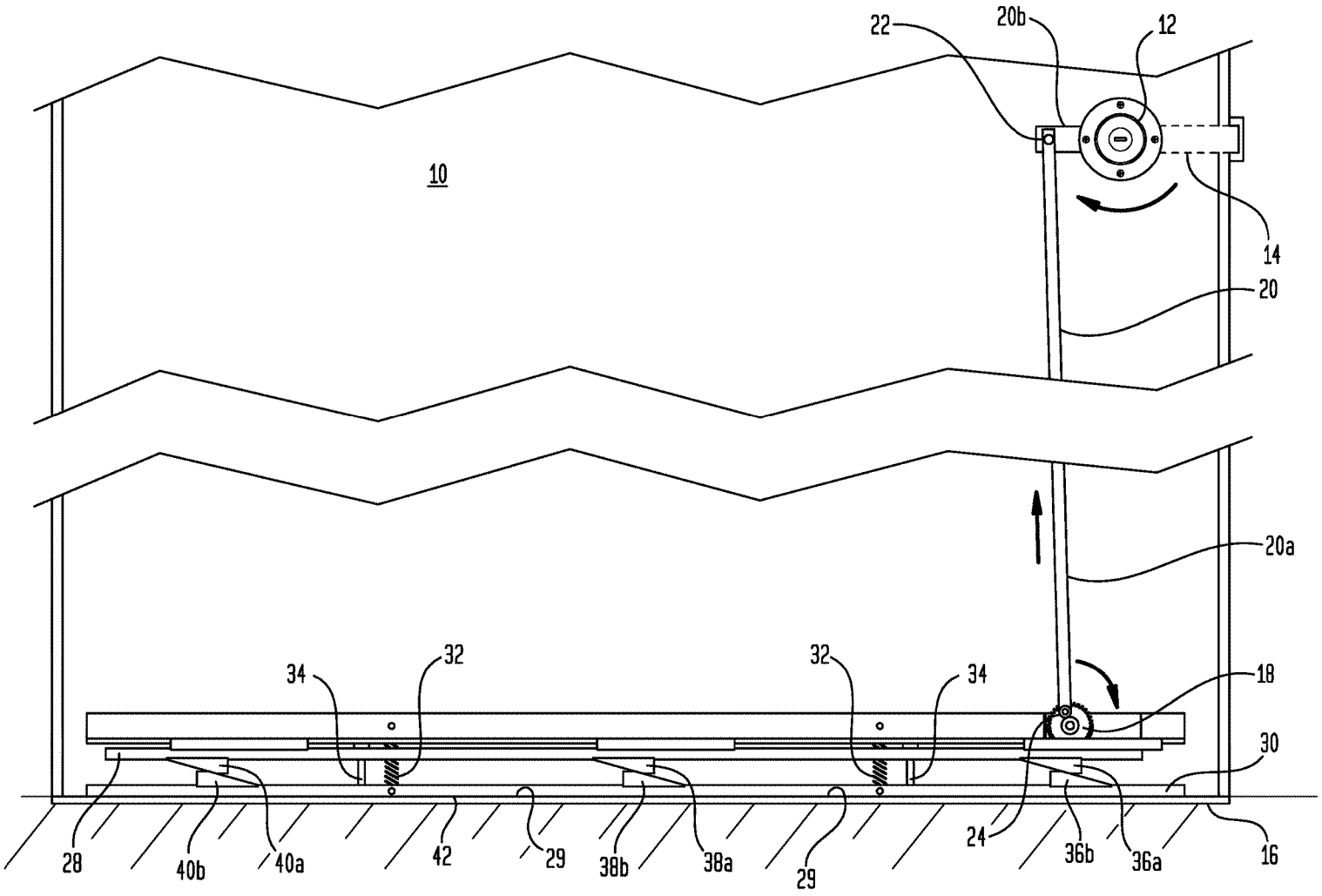
FIG. 2 is an elevation view of the door of FIG. 1, showing the gasket in a position abutting the adjacent frame surface of the door saddle.

Inside the door is a gear 18 mounted near the bottom of the door for rotation relative to the door between a first position wherein the latch is withdrawn and the door is disengaged from the door frame such that the door can be opened (as seen in FIG. 1) and a second position wherein the latch is extended and engages the door frame to keep the door closed (as seen in FIG. 2).

A mechanical linkage, generally designated 20, extends within the door to connect knob 12 and gear 18. As knob 12 is rotated in a clockwise direction from its first position shown in FIG. 1 in which the door is unlatched to its second position shown in FIG. 2 in which the door is latched, gear 18 is rotated in a clockwise direction from its first position shown in FIG. 1 to its second position shown in FIG. 2. Linkage 20 includes an elongated main section 20*a* connected at its upper end by a pivot pin 22 to a link 20*b* which moves with knob 12, and at is lower end by a pivot pin 24 extending from the surface of gear 18.

Figure 3:
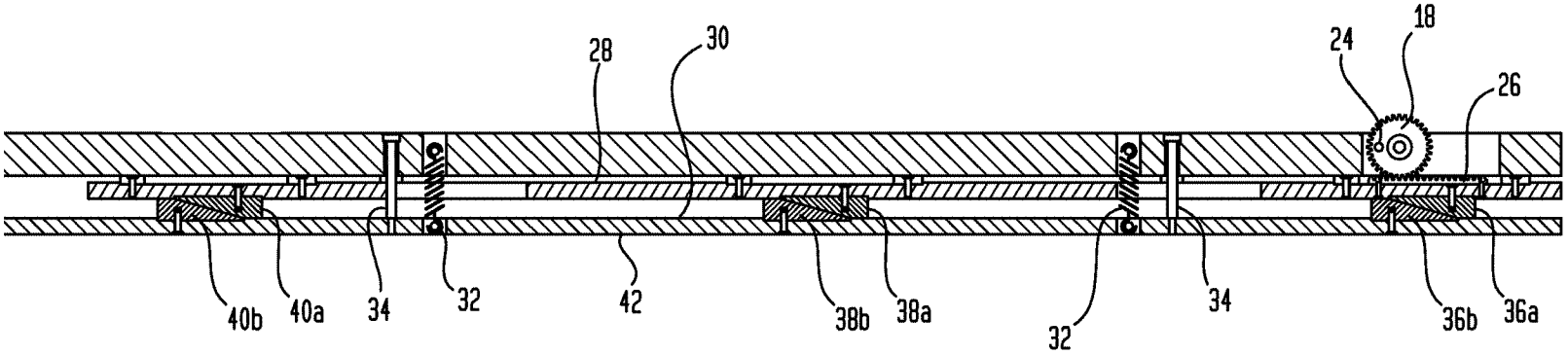
FIG. 3 is a cross-sectional view of the bottom of the door of FIG. 1.

As best seen in FIG. 3, a rack 26 is mounted on a first bar 28 at a position wherein the rack is engaged by gear 18. As gear 18 is rotated, rack 26, and the first bar 28 to which the rack is attached, moves in a linear path substantially parallel to but spaced from surface 29 of saddle.

A second bar 30 is mounted below and spaced a short distance from first bar 28. Second bar 30 is connected to first bar 28 at two locations by assemblies that allow the second bar to move toward and away from first bar 28 but not in a direction parallel to first bar 28.

Each of the bar connecting assemblies includes a spring 32 and a bolt 34. In each assembly, spring 32 urges second bar 30 toward first bar 28. Each bolt 34 has an enlarged head which is captured in a bore hole in first bar 28 having an opening smaller than the bolt head such that the bolt can move up and down within the bore but not exit the bore opening. In this manner, second bar 30 and can move relative to first bar 28 only in a direction which is substantially perpendicular to the adjacent saddle surface 29.

Springs 32 urge second bar 30 toward first bar 28 in order to maintain contact between the inclined surfaces of oppositely oriented triangular shaped members. The triangular members form spaced triangular member sets, three of which are shown. Each triangular member set 36, 38 and 40 includes two triangular members which cooperate to regulate the vertical distance between the first and second bars.

Triangular member set 36 includes triangular members 36*a* and 36*b*. Triangular member set 38 includes triangular members 38*a* and 38*b*. Triangular member set 40 includes triangular members 40*a* and 40*b*. In each triangular member set, the upper triangular member 36*a*, 38*a* and 40*a* is attached to first bar 28 and the lower triangular member 36*b*, 38*b* and 40*b* is attached to second bar 30.

Rack 26 and the upper triangular members 36*a*, 38*a* and 40*a* of each set are attached to and move with the first bar 28, as gear 18 is rotated. Because the lower triangular members are mounted on and move with the second bar, and the second bar can only move in a direction perpendicular to the path of movement of first bar 28, as the first bar 28 moves, the upper and lower triangular members in each triangular member set cooperate to move second bar 30 toward and away from the first bar 28.

A rubber gasket or layer 42 is attached to the bottom of second bar 30. When second bar 30 is moved to its position abutting saddle surface 29, rubber gasket or layer 42 will press against the surface of the door saddle and seal the bottom of the door to the saddle surface, as illustrated in FIG. 2.

When knob 12 is rotated to unlatch the door, mechanical linkage 20 will rotate gear 18. The rotation of gear 18 will cause rack 26 and thus first bar 28 to move back to the position seen in FIG. 1. That will cause the triangular members to move back to their original positions and second bar 30 to move away from the saddle such that the door is no longer sealed and can be opened.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

We claim:

1. A system for automatically sealing a fenestration member to an adjacent surface, the fenestration member having a moveable latch configured to engage a frame surrounding the fenestration member, the system comprising:

a gear rotatably mounted to the fenestration member;

a latch control member connected to the gear by a mechanical linkage, the mechanical linkage being pivotably connected to the gear, the latch control member and mechanical linkage being disposed proximate to a first edge of the fenestration member, wherein the latch control member is configured to rotate from a first position to disengage the movable latch from the frame to a second position to engage the movable latch with the frame, wherein rotation of the latch control member causes the mechanical linkage to transmit force to cause rotation of the gear;

a rack engaged with the gear and mounted to a first bar, the first bar being configured to translate in a first direction parallel to a second edge of the fenestration member in response to rotation of the gear, the second edge being perpendicular to the first edge;

a first triangular member mounted on the first bar to translate with the first bar in the first direction;

a second bar extending parallel to the second edge of the fenestration member and moveable in a second direction perpendicular to the first direction;

a second triangular member mounted on the second bar in a position engageable with the first triangular member, wherein in response to movement of the first bar in the first direction, engagement of the first triangular member with the second triangular member causes movement of the second bar in the second direction; and a gasket mounted to move with the second bar, wherein the gasket is configured to seal the second edge of the fenestration member to the adjacent surface when the latch control member is in the second position.

2. The system of claim 1 wherein the first triangular member comprises a first inclined surface and the second triangular member comprises a second inclined surface, the first and second inclined surfaces being in complementary engagement with each other.

3. The system of claim 2 wherein the first inclined surface and the second inclined surface cooperate to move the gasket toward and away from the second edge.

4. The system of claim 1 further comprising a spring operably coupling the first bar and the second bar, wherein the spring urges the first triangular member and the second triangular member toward each other.

5. The system of claim 1 further comprising means for preventing the gasket from moving in the first direction.

6. The system of claim 1, further comprising one or more springs connecting a second bar to the fenestration member at a location proximate the second edge of the fenestration member, the one or more springs exerting a force to urge the second bar in a direction toward the first bar.

7. The system of claim 1 further comprising means for preventing the second bar from moving in the first direction.

8. The system of claim 1, wherein the gasket comprises a rubber layer disposed on the second bar.

9. The system of claim 1, wherein the second bar is disposed closer to the second edge of the fenestration member than the first bar.

10. The system of claim 1, wherein the latch control member is actuatable via rotation.

11. The system of claim 1, wherein the latch control member is pivotably coupled to the mechanical linkage.

12. A system for sealing a fenestration member to an adjacent surface, the system comprising:

a latch moveable between a latch first position, the first latch position being retracted in a direction inwardly away from a first edge of the fenestration member so as to unlatch the fenestration member from an adjacent frame, and a second latch position, the second latch position being extended in a direction outwardly away from the first edge of the fenestration member;

a latch control member accessible from an exterior of the fenestration member and operably coupled to the latch, wherein actuation of the latch control member moves the latch from the second position to the first position;

a gear rotatably mounted proximate a second edge of the fenestration member, the second edge being perpendicular to the first edge;

a mechanical linkage connecting the latch control member and the gear, the mechanical linkage transmitting force from actuation of the latch control member to cause rotation of the gear, wherein the mechanical linkage is disposed proximate to and extends in a direction along the first edge of the fenestration member;

a first bar having a rack operably coupled to the gear, the first bar extending parallel to and proximate the second edge of the fenestration member, the first bar being moveable in translation in a direction parallel to the second edge in response to rotation of the gear;

a second bar extending parallel to and proximate the second edge of the fenestration member, the second bar being moveable in a direction perpendicular to the direction of translation of the first bar in response to translation of the first bar;

complementary cam members being disposed on the first bar and the second bar, respectively, wherein in response to movement of the first bar, the complimentary cam members engage and cause movement of the second bar; and a gasket fixedly mounted to the second bar, wherein movement of the second bar causes movement of the gasket in the direction perpendicular to the direction of translation of the first bar such that the gasket is capable of sealing between the second edge of the fenestration member and the adjacent surface.

13. The system of claim 12, wherein respective surfaces of the respective complementary cam members comprise oppositely directed inclined surfaces engaged with each other.

14. The system of claim 12, wherein the second bar is disposed closer to the second edge of the fenestration member than the first bar.

15. The system of claim 12, wherein the latch control member is actuatable via rotation.

16. The system of claim 12, wherein the latch control member is pivotably coupled to the mechanical linkage.

17. The system of claim 12 further comprising one or more springs operably connecting the second bar to the fenestration member, the one or more springs being arranged to exert a force to urge the second bar in a direction toward the first bar.

18. The system of claim 12 further comprising means for preventing the second bar from moving in the direction parallel to the second edge.

19. The system of claim 12, wherein the gasket comprises a rubber layer disposed on the second bar.

* * * * *